US005850660A

United States Patent [19]

O'Halloran

[11] Patent Number: 5,850,660

[45] Date of Patent: Dec. 22, 1998

[54] TOOTHBRUSH WITH HEXAGONAL BRISTLES IN HEXAGONAL TUFT HOLES

[75] Inventor: James O'Halloran, Kutztown, Pa.

[73] Assignee: Radius Inc., Kutztown, Pa.

[21] Appl. No.: 590,406

[22] Filed: Jan. 25, 1996

[51] Int. Cl.[6] ..... A46B 3/16

[52] U.S. Cl. ..... 15/195; 15/167.1; 15/207.2

[58] Field of Search ..... 15/167.1, 190, 15/191.1, 195, 205, 207.2

[56] References Cited

U.S. PATENT DOCUMENTS 2,317,485 4/1943 Rider ..... 15/207.2 X
4,617,695 10/1986 Amos et al. ..... 15/195

FOREIGN PATENT DOCUMENTS 652769 2/1992 Australia ..... 15/167.1
420005 1/1910 France ..... 15/195

*Primary Examiner*—Mark Spisich
*Attorney, Agent, or Firm*—Darby & Darby

[57] ABSTRACT

A toothbrush with a bristle head that has densely packed hexagonal tuft holes and hexagonal cross section bristles exhibits increased bristle retention. The increased bristle retention is achieved by increasing the anchored length of the tuft staple without increasing the overall length of the staple. Where the hexagonal tuft holes are of the same area as conventional round tuft holes, and the anchoring staples are of the conventional length, the "anchored" length of the staple is increased by 25%. Bristle retention is further increased by the increased friction of the flat surfaces of hexagonal bristles against each other and against the flat surfaces of hexagonal tuft holes.

7 Claims, 2 Drawing Sheets

TOOTHBRUSH WITH HEXAGONAL BRISTLES IN HEXAGONAL TUFT HOLES

FIELD OF THE INVENTION

This invention generally relates to toothbrushes, and more particularly to toothbrushes having hexagonal cross section bristle tuft holes and hexagonal cross section bristles.

BACKGROUND OF THE INVENTION

It is desirable in toothbrush design to provide a brush head with bristles packed as densely as possible. Bristle density may be increased by increasing the number of bristles in a tuft, or by increasing the number of tufts on a brush head, without increasing the size of the brush head. For structural reasons, a minimum distance must be maintained between tuft holes. The minimum distance between tufts ensures that adequate brush head material exists to support the anchored end of the bristle tufts and to support the staple which anchors the tufts.

It is known to provide more bristles on a bristle head by the use of angular tuft holes, including hexagonal holes. By designing the tuft holes to have a hexagonal shape and arranging those holes in a honeycomb pattern, it is possible to increase the number of tuft holes without increasing the size of the brush head and while maintaining the minimum distance between tuft holes. Although the number of bristle bundles is increased by providing hexagonal bristle holes, the number of conventional bristles per bundle will be substantially the same.

It is also desirable to provide a brush head body of a thickness adequate to securely retain bristles while minimizing the thickness of the brush head body for user comfort. A brush head body of a minimum thickness results in a brush which is more comfortable in the user's mouth. However, a brush head body that is too thin to adequately support bristles, would allow bristles to dislodge from the brush head in the user's mouth during the brushing operation. In conventional toothbrushes, adequate bristle retention has been provided by fastening bristle tufts in tuft holes that are approximately twice as deep as their diameter. Since the tuft holes generally do not pass through the back of the toothbrush head, this tuft hole depth in turn determines the thickness of the body of the bristle head.

It is therefore an object of the invention to provide a toothbrush which overcomes the deficiencies of the prior art.

It is another object of the invention to increase the number of bristles on a brush head without increasing the size of the brush head.

It is another object of the invention to increase the bristle retention in the bristle tuft hole.

It is another object of the invention to provide a bristle head with a substantially thinner head body.

SUMMARY OF THE INVENTION

In a toothbrush with a bristle head that has densely packed hexagonal tuft holes, bristle retention is increased by using hexagonal cross section bristles and by increasing the anchored length of the tuft staple. Where the hexagonal tuft holes are of the same area as conventional round tuft holes, and the anchoring staples are of the conventional length, the "anchored" length of the staple is increased by 25%. Bristle retention is further increased by the increased friction of the flat surfaces of hexagonal bristles against each other and against the flat surfaces of hexagonal tuft holes.

BRIEF DESCRIPTION OF THE DRAWINGS

To fully understand the invention, reference is made to the following description taken in connection with the accompanying drawings, in which.

DETAILED DESCRIPTION OF THE PREFERRED EMBODIMENT

Figure 1:
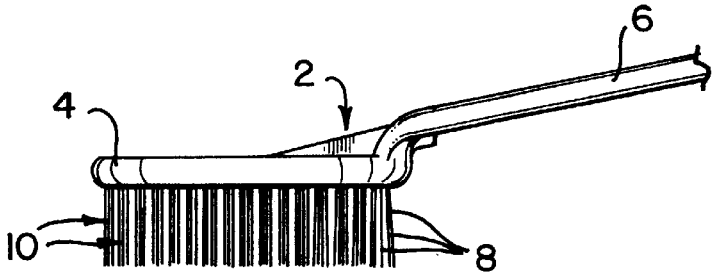
FIG. 1 is a side elevation view of the brush head and small portion of handle, in accordance with the invention.
Figure 2:
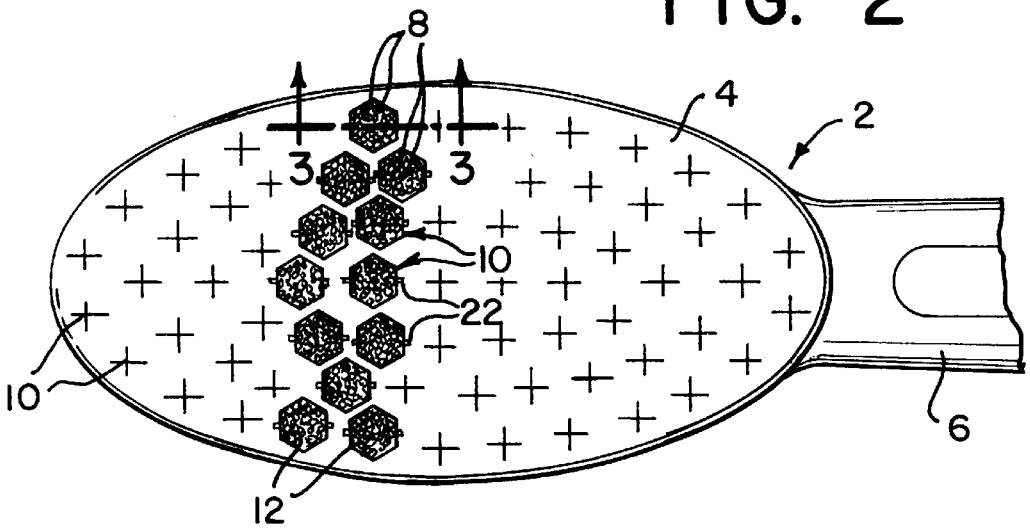
FIG. 2 is an enlarged plan view of the brush head and associated bristles bundles illustrating the spacing thereof, in accordance with the invention.
Figure 3:
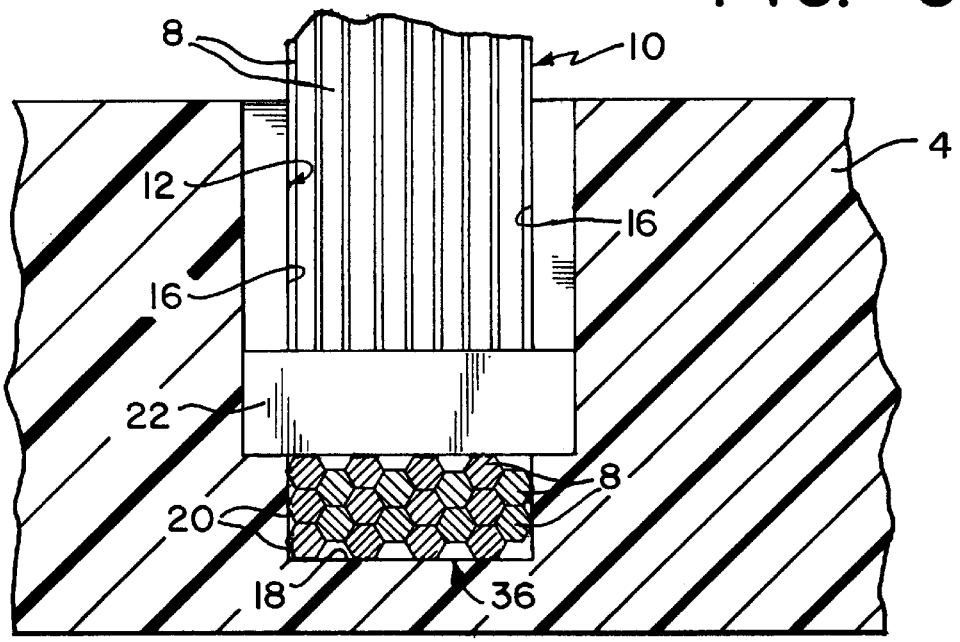
FIG. 3 is a sectional view through the brush head of FIG. 2 showing details of construction, in accordance with the invention.
Figure 4:
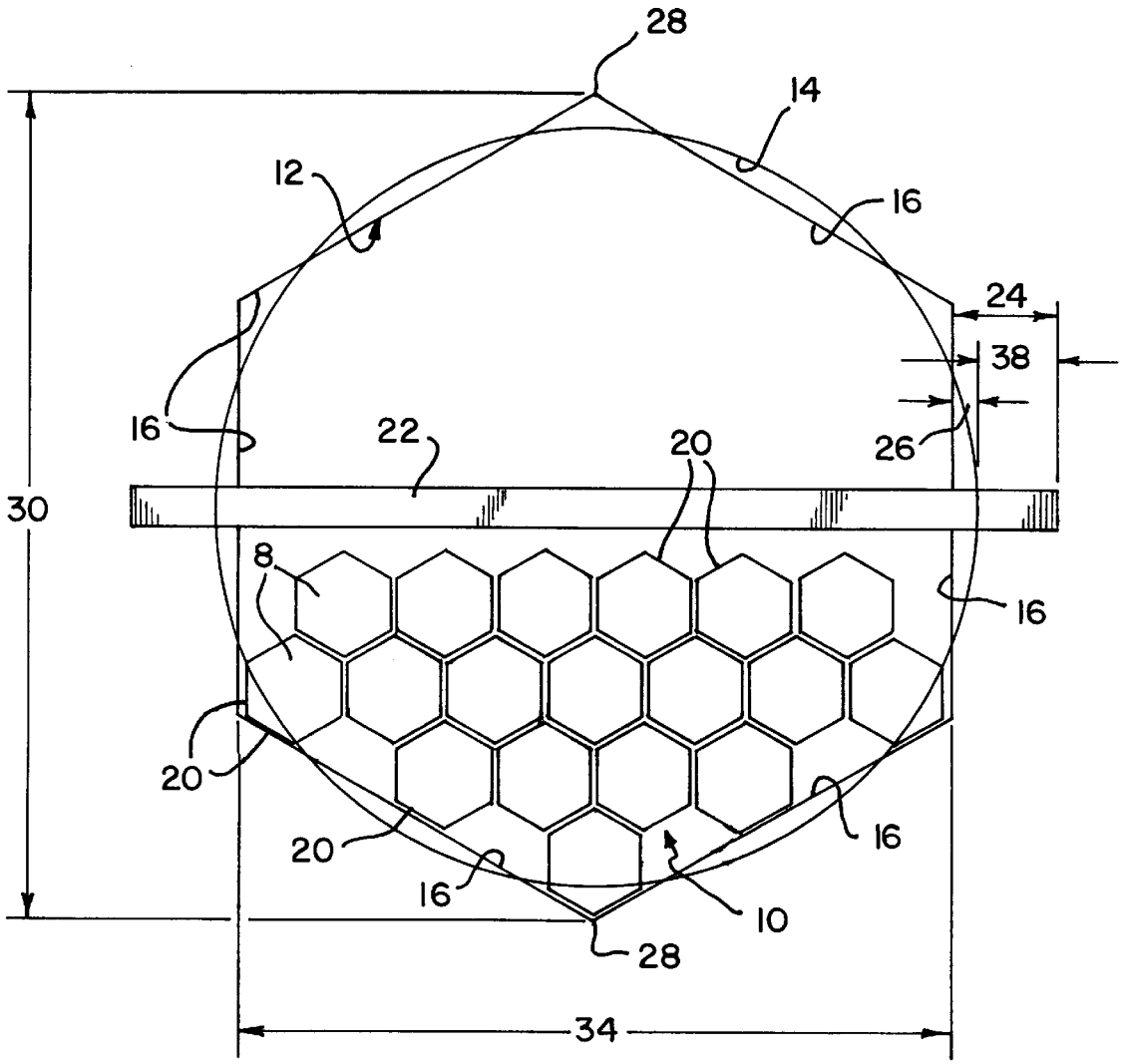
FIG. 4 is a diagrammatic plan view illustrating dimensions of the hexagonal cross section tuft hole in accordance with the invention, vis-a-vis the prior art round cross section tuft hole.

Referring to FIGS. 1 and 2, a toothbrush 2 is shown having a bristle head 4, a handle 6 (only a portion of which is illustrated) and bristles 8 gathered in bristle tufts 10. The bristles 8 are hexagonal in cross section and have flat surfaces 20 on six sides, as illustrated in FIGS. 3 and 4. Nylon monofilament hexagonal bristles, such as, for example, DuPont Tynex® bristles, may be used, however, those skilled in the art will appreciate that other brands of hexagonal bristles, as well as other materials are contemplated. The bristles 8 are assembled into a bundle 10, the bundle is folded in the middle so that opposite ends of the bundle end up adjacent to each other to form the tufts 10. By folding the bundle of bristles, a u-shaped loop is formed at the base 36 of the tuft 10.

The bristle tufts 10 are secured in hexagonal tuft holes 12 by flat wire staples 22, although it will be appreciated by those in the art that other methods of securing the tufts are contemplated. The tuft holes 12 have six parallel side walls 16 and a bottom wall 18. The flat wire staple 22 is longer than the width 34 of the tuft hole 12. The staple 22 passes through the un-shaped loop in the tuft 10, and the free ends of staple 22 in the walls 16 of the tuft hole 12.

Securing hexagonal bristles 8 in hexagonal tuft holes 12 results in increased bristle retention through increased frictional contact. Referring how to FIGS. 3 and 4, the flat side walls 16 of the tuft holes 12 frictionally engage the flat surfaces 20 of the hexagonal bristles 8. The flat surfaces 20 of the hexagonal bristles 8 also frictionally engage the flat surfaces 20 of adjacent bristles 8.

Bristle retention is further enhanced over conventional construction by the increase in the anchored length 24 of the flat wire staple 22 on each end thereof. The flat wire staple 22 is of a length, such as for example, 0.086 inch, used in a conventional construction round tuft hole 14 having a diameter, for example, of 0.070 inch. The anchored length 38 of the staple in a round hole is 0.008 inch on each end of the staple. This anchored length is a maximum dimension, determined in a conventional toothbrush construction by the amount of brush head material between tuft holes, and between the tuft holes and the side wall of the brush head. If the anchored length of the staples exceeds the dimensions of the material between tuft holes, or between the tuft holes and the side wall of the brush head, the staples from one tuft will interfere with adjacent tuft holes, or will break through the side wall of the brush head.

The hexagonal tuft hole 12 has a major diameter 30 measured from opposite corners 28 and a minor diameter 34 measured from opposite sides 16. A hexagonal tuft hole having a major diameter 30 of, for example, 0.077 inch will have the same cross sectional area as the round tuft hole 14 having a diameter of 0.070 inch. However, standard hexagonal production tool pins are not available in the 0.077 inch pin diameter. Tool steel suppliers do manufacture hexagonal pin tools having a major diameter of 0.078 inch, and having a minor diameter of 0.0624 inch. The hexagonal tuft holes 12 with a major diameter of 0.078 inch are of substantially the same cross sectional area as a conventional round tuft hole 14 having a diameter of 0.070 inch, as illustrated in FIG. 4. However, when a conventional length flat staple 22 is centered in the hexagonal tuft hole 12 and positioned along the minor diameter 34 of, for example 0.0624 inch, the anchored length of staple 22 is 0.0118 inch on each end. This provides an increased anchored length of 0.0038 inch on each end of the staple 22. The increased anchored length of the staple 22 results in increased overall bristle retention.

The use of hexagonal bristles in hexagonal tuft holes may also present advantages in the manufacture of larger brushes such as hair brushes. Larger brushes do not use staples which anchor in the side wall of the tuft hole but rather use staples which anchor in the bottom of the tuft hole. Bottom anchoring constructions would benefit from the increased friction of hexagonal bristles against hexagonal tuft holes, and would also benefit from the denser packing provided by hexagonal bristles.

The increased bristle retention resulting from greater bristle friction and increased staple anchor length presents another advantage for the manufacture of toothbrushes. The thickness of the brush head may be reduced to increase user comfort. Conventionally, brush head thickness is determined by the depth of the tuft holes combined with the minimum amount of material necessary to form the back face of the brush head and the back wall of the tuft hole. Generally, tuft holes are twice as deep as their diameter. For a conventional round cross section tuft hole of 0.070 inch diameter, a tuft hole depth of 0.140 inch is required. This depth does not include the material necessary to form the back face of the brush head. The increased bristle retention available in the present invention allows the tuft hole depth to be reduced to 0.125 inch. The total thickness of the brush head is only 0.145 inch.

The hexagonal shape of the bristles 8 also allows a denser bundling of the tuft 10 because the hexagonal bristles 8 tend to cluster in a honeycomb-like configuration. FIG. 4 The honeycomb-like configuration of hexagonal bristles 8 in tuft 10 has fewer voids than a conventional tuft with round bristles. The denser tufts present a neater appearance in the finished brush product.

Other embodiments will occur to those skilled in the art and are within the scope of the following claims:

What is claimed is:

1. A brush having a handle, comprising:

a brush head having a plurality of tuft receiving holes, each of said tuft receiving holes having a hexagonal cross-section defined by opposite pairs of side walls which are parallel, each of said side walls providing a flat inwardly facing surface;

a plurality of bristle bundles, each said bristle bundle having a portion positioned in and secured in a respective one of said tuft receiving holes, and each said bristle bundle having a plurality of hexagonal cross-section bristles, each said hexagonal cross-section bristle having opposite pairs of flat surfaces, said hexagonal cross-section bristles arranged in each said bundles such that a plurality of outwardly facing flat bristle surfaces about the periphery of said portion of each said bristle bundle within said respective tuft receiving hole are aligned and in frictional engagement with one of said flat inwardly facing surfaces of said tuft receiving hole side walls.

2. The brush according to claim 1 wherein said portion of each said bristle bundles positioned in said respective tuft receiving hole is secured by anchor means.

3. The brush according to claim 2 wherein said anchor means comprises an anchor staple.

4. The brush according to claim 3, wherein the anchor staple comprises a flat wire.

5. The brush according to claim 4 wherein said anchor staple has opposite free ends extending into and engaging respectively one of said pairs of opposite side walls.

6. The brush according to claim 3 wherein said opposite pairs of sidewalls of each of said tuft receiving holes have first ends and second ends respectively, said first ends define a tuft receiving hole opening, said second ends define a tuft receiving hole bottom wall, and said anchor staple having free ends extending into and engaging said bottom wall.

7. The brush according to claim 1, wherein each of said bristle bundles is formed from a plurality of bristles having opposite free ends, said plurality of bristles being folded so that said opposite free ends of said bristles are adjacent to each other, said plurality of folded bristles forming a bristle tuft having a folded portion and a free end portion, and said bristle tuft folded portion is said bristle bundle portion which is positioned in and secured in said tuft receiving hole.

* * * * *